United States Patent [19]

Bronder et al.

[11] Patent Number: 4,647,111

[45] Date of Patent: Mar. 3, 1987

[54] SLEEVE INSERT MOUNTING FOR MINING PICK

[75] Inventors: Walter Bronder, Wiebelskirchen; Gerd Spiekers, Wermelskirchen, both of Fed. Rep. of Germany

[73] Assignee: Belzer-Dowidat GmbH Werkzeug-Union, Fed. Rep. of Germany

[21] Appl. No.: 736,720

[22] Filed: May 22, 1985

[30] Foreign Application Priority Data

Jun. 9, 1984 [DE] Fed. Rep. of Germany ..... 3421676

[51] Int. Cl.[4] ..... E21C 25/12; E21C 35/18

[52] U.S. Cl. ..... 299/79; 175/410

[58] Field of Search ..... 175/410; 299/86, 79; 407/118

[56] References Cited

U.S. PATENT DOCUMENTS

| | | | |
|---|---|---|---|
| 3,749,190 | 7/1973 | Shipman | 175/410 |
| 3,852,874 | 12/1974 | Pearson | 175/410 X |
| 4,575,156 | 3/1986 | Hunter et al. | 299/86 X |

FOREIGN PATENT DOCUMENTS

| | | | |
|---|---|---|---|
| 2101657 | 1/1983 | United Kingdom | 299/79 |
| 582399 | 11/1977 | U.S.S.R. | 175/410 |
| 898035 | 1/1982 | U.S.S.R. | 175/410 |

*Primary Examiner*—James A. Leppink
*Assistant Examiner*—Michael A. Goodwin
*Attorney, Agent, or Firm*—Diller, Ramik & Wight

[57] ABSTRACT

A rotatable tool which includes a pick carrier having a recess which receives one end of a rod-shaped support secured thereto, an opposite end of the rod-shaped support as a right-cylindrical bore opening axially outwardly of an end face thereof, a pick bit is formed by a shaft having a right-cylindrical bore and a bit-end, and the shaft is received in a split sleeve which in turn is received in the bore to press-fit the bit in the bore.

10 Claims, 4 Drawing Figures

FIG.1
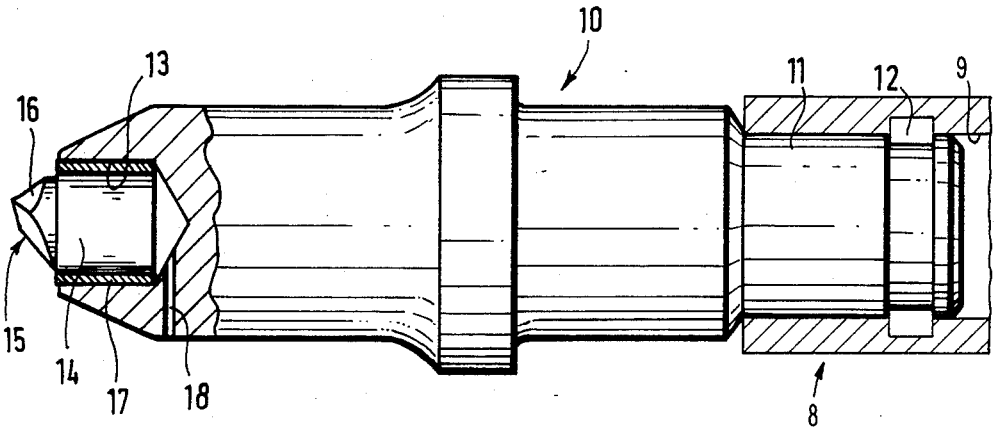
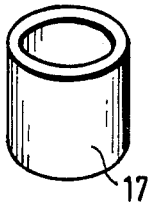
FIG.2
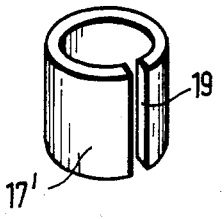
FIG.3
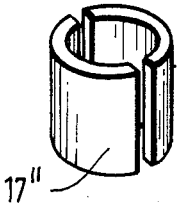
FIG.4

SLEEVE INSERT MOUNTING FOR MINING PICK

The invention relates to a pick comprising a substantially rod-shaped support and a pick bit of hard metal fixed in a recess of the support.

Picks are used in mining as tools to break carbon, rock or the like. A rotating pick carrier is provided with a number of picks acting on the rock with their respective bits.

In the known picks, the pin-shaped bits are soldered into a recess of the support, said soldering being carried out upon the heat-treatment of the carrier or support. The temperature required for soldering is above the transition point of the carrier material. Thus, upon the soldering, varying structures (martensite, austenite etc.) are formed near the pick bit, i.e. in the support region exposed to the highest stress so that the stability of the carrier material in this critical area is reduced.

It has been known to solder the pick bit into the carrier material prior to the tempering operation. During the subsequent tempering, the temperature is increased to the working temperature of the solder which, as a rule, is above the transition point. While the liquid point of silver solder is lower, silver is extremely expensive for the purpose in question.

Further, it is disadvantageous that the thermal expansion coefficients of solder, carrier material and hard metal differ from one another so that tensions formed during the thermal aftertreatment probably cause cracks in the hard metal which is very sensitive against tensile stress.

Both cases mentioned above are involved with the additional drawback that either during the soldering or during the hardening of the carrier material, the hard metal is heated above 800° C. With the supply of air, said thermal treatment entails the destruction of the tungsten carbide and tungsten acid is set free. The risk of crack formation may be only avoided by performing the thermal treatment under protective gas atmosphere which, however, substantially increases the production cost. Last off, the hard metal is sensitive to a shock-like cooling causing cracks. Therefore, cooling must be effected in graphite.

It is the object of the invention to provide a pick of the foregoing type having a defined stability over the total support body and a longer service life accordingly.

The problem is solved according to the invention in that a bushing is forced into a snug fit between the pick bit and the wall of the recess.

According to the invention, the pick bit is not soldered to the support, but a bushing applied by pressure, is responsible for its fixation. Thus, the support without the inserted pick bit may be hardened or heat-treated under optimum conditions to obtain a uniform metal structure. The bushing snugly fitted between the bit and the support compensates probable thermal stresses in operation during which temperatures as high as 500° C. may come up. The different thermal expansions of the support and the pick bit are compensated by the bushing. Since the carrier material structure is not thermally changed during the insertion of the bit, the stability of the carrier near the bit is excellent. Crack formations of the pick bit are excluded as well, and the resistance to impact and shock stresses such as particularly observed in mining, is increased accordingly.

No thermal energy is required for the fixation of the pick bit, and there is no need for a temperature adjustment. The protective gas atmosphere and the usual decarbonization are out of consideration.

The invention is useful in case of all picks having round bits, in particular for picks having a round shaft.

Preferably, the bushing is made of tool steel. It may consist of a cylindrical sleeve, or it may be of a longitudinally partitioned or slotted design.

The invention also relates to a process for the production of picks consisting of a hardened, rod-shaped support and of a bit fixed in a recess of the support. The process is characterized in that a bushing is pressed in cold on the pick bit and that the latter together with the bushing is pressed in cold into the recess of the heat-treated support.

One embodiment of the invention will be explained hereunder in more detail with reference to the drawings.

FIG. 1 is a side view, partly broken away, of the pick,

FIG. 2 is a perspective view of a first embodiment of the bushing,

FIG. 3 is a longitudinally slotted bushing,

FIG. 4 is a partitioned bushing.

The illustrated rotatable pick carrier 8 contains a bore 9 which receives a rod-shaped support 10 of an associated pick (unnumbered). A locking groove 12 is provided to fix the support 10 in the bore 9 of the pick carrier 8. Said support 10 is made of heat-treated steel.

At the front end of the support 10, a cylindrical recess 13 or bore receives the cylindrical shaft 14 of the pick bit 15. The portion 16 of the pick bit 15 projecting from the recess 13 is tapered to the outside to attack the surface to be removed.

The shaft 14 of the pick bit 15 is encompassed by a cylindrical heat-treated steel bushing 17 (FIGS. 1 and 2) forced into a press fit between the wall of the recess 13 and the shaft 14 and being made of tool steel. Its wall thickness is about 1 mm. The bushing 17 together with the shaft 14 of the pick bit are pressed into the recess 15 upon the previous termination of the thermal treatment of the support 10.

FIGS. 2 through 4 show various embodiments of bushings of this invention with FIG. 2 corresponding to the embodiment of the bushing 17 shown in FIG. 1 in association with the rod-shaped support 10. The bushing 17 is formed as a cylinder having a continuously closed wall. A bushing 17' of FIG. 3 has an elongated slot 19 while bushing 17'' of FIG. 4 consists of two semi-cups resulting in a cylindrical form when composed. The advantage involved with the slotted or partitioned embodiment resides in the better adjustment of the bushing when it is mounted on the annular gap between the shaft 14 and the wall of the recess 13.

The support 10 is provided with a small transverse bore 18 ending in the bottom of the recess 13 to ventilate the recess when the pick bit and the bushing 17 are introduced by pressing to avoid the formation of accumulated air in the recess.

What is claimed is:

1. A rotatable tool comprising a pick carrier having at least one recess, at least one pick, said pick being defined by a pick bit and a substantially rod-shaped support having axially opposite first and second ends, said support first end being received in said pick carrier one recess, means associated with said support first end for locking said rod-shaped support first end in said one recess, said support second end having a generally right-cylindrical bore opening axially outwardly of an end face of said support second end, said pick bit being composed of hard metal and having first and second ends, said first end being a shaft housed inn said right-cylindrical bore, said shaft having a generally right-cylindrical outer surface and defining with said bore an annular gap, a bushing formed by a cylindrical sleeve press-fit in said gap thereby holding said shaft first end in said bore, said cylindrical sleeve having an outer cylindrical surface, at least one slot disposed lengthwise of said cylindrical sleeve between opposite end faces thereof to thereby ventilate said pick bit as the pick bit and bushing are introduced and press-fit into said bore to avoid the accumulation of air therein and said shaft, bore, cylindrical sleeve and support having generally coextensive axes.

2. The rotatable tool as defined in claim 1 including another bore extending through said support second end into said right-cylindrical bore.

3. The rotatable tool as defined in claim 2 wherein said one slot extends entirely through and end-to-end of said bushing.

4. The rotatable tool as defined in claim 2 wherein said one slot and another slot each extend entirely through and end-to-end of said bushing to thereby define two separate bushing portions.

5. The rotatable tool as defined in claim 2 including another bore extending through said support second end into said right-cylindrical bore at a bottom thereof.

6. The rotatable tool as defined in claim 2 wherein said bushing is made of tool steel.

7. The rotatable tool as defined in claim 2 wherein said bushing is made of heat-treated steel.

8. The rotatable tool as defined in claim 1 wherein said one slot extends entirely through and end-to-end of said bushing.

9. The rotatable tool as defined in claim 1 wherein said one slot and another slot each extend entirely through and end-to-end of said bushing to thereby define two separate bushing portions.

10. The rotatable tool as defined in claim 1 including another bore extending through said support second end into said right-cylindrical bore at a bottom thereof.

* * * * *